US006425797B1

(12) United States Patent
Wu

(10) Patent No.: US 6,425,797 B1
(45) Date of Patent: Jul. 30, 2002

(54) WHEEL ASSEMBLY

(76) Inventor: Jung-Jyh Wu, No. 20, Da Yeou 1st Street, Da Lian Shiang, Kaohsiung Hsien (TW)

( * ) Notice: Subject to any disclaimer, the term of this patent is extended or adjusted under 35 U.S.C. 154(b) by 0 days.

(21) Appl. No.: 09/990,272

(22) Filed: Nov. 23, 2001

(30) Foreign Application Priority Data

Sep. 20, 2001 (TW) ..... 090216618

(51) Int. Cl.[7] ..... A63H 11/00

(52) U.S. Cl. ..... 446/330; 16/30; 16/35 R; 16/45

(58) Field of Search ..... 446/330, 269, 446/279, 289; 16/107, 45, 30, 35 R

(56) References Cited

U.S. PATENT DOCUMENTS 1,661,889 A * 3/1928 French et al.
1,709,845 A * 4/1929 Eberly
5,607,030 A * 3/1997 Swift ..... 188/1.12
5,787,547 A * 8/1998 Joseph et al. ..... 16/35 R

* cited by examiner

*Primary Examiner*—Derris H. Banks
*Assistant Examiner*—Jamila Williams
(74) *Attorney, Agent, or Firm*—Rosenberg, Klein & Lee

(57) ABSTRACT

A wheel assembly comprises a wheel-mounting base, a wheel, an axle, and two fixing members. The wheel-mounting base comprises a compartment that is delimited by two sidewalls having aligned axle holes. The axle extends through the axle holes of the wheel-mounting base and an axle hole of the wheel received in the compartment. The fixing members are respectively mounted to the sidewalls of the wheel-mounting base. Each fixing member comprises an axle-receiving hole for securely engaging with an associated one of the ends of the axle. Each fixing member is movable between a first angular position in which the fixing member is disengagable from an associated one of the sidewalls of the wheel-mounting base and a second angular position in which the fixing member is securely engaged with the associated one of the sidewalls of the wheel-mounting base.

10 Claims, 3 Drawing Sheets

WHEEL ASSEMBLY

BACKGROUND OF THE INVENTION

1. Field of the Invention

The present invention relates to a wheel assembly for a toy, baby utensil, or sport equipment that allows easy assembly and that provides a secure engagement as well as an aesthetically pleasing effect.

2. Description of the Related Art

A toy, baby utensil, or sport equipment is generally provided with at least one wheel to allow movement. In a typical design for mounting a wheel, a wheeled object comprises a compartment in an underside thereof for receiving a wheel. Two sidewalls defining the compartment have aligned holes, and an axle or shaft is extended through the holes in the sidewalls and an axle hole in the wheel. Pins are provided to secure-two ends of the axle in place. In another design for mounting a wheel, a wheeled object comprises a compartment in an underside thereof for receiving a wheel. Each sidewall defining the compartment has an inverted U-shaped opening. An axle or shaft is extended through an axle hole in the wheel. In addition, each of two ends of the axle has a groove for receiving an edge of an associated sidewall. The ends of the axle in both designs are exposed and thus fail to provide an aesthetically pleasing effect. In addition, the exposed ends of the axle are apt to be damaged in addition to accumulation of dirties. Further, the wheel tends to wobble and thus is in frictional contact with the sidewalls, which leads to non-smooth rotation of the wheel. Further, the structural strength of the latter design is insufficient in view of positioning of the wheel.

SUMMARY OF THE INVENTION

An object of the present invention is to provide a wheel assembly for a toy, baby utensil, or sport equipment that allows easy assembly and that provides a secure engagement as well as an aesthetically pleasing effect.

A wheel assembly in accordance with the present invention comprises a wheel-mounting base that is a portion of one of a toy, baby utensil, and sport equipment, a wheel, an axle, and two fixing members. The wheel-mounting base comprises a compartment that is delimited by two sidewalls having aligned first axle holes. The wheel is received in the compartment of the wheel-mounting base and comprises a second axle hole. The axle extends through the first axle holes of the wheel-mounting base and the second axle hole of the wheel with two ends of the axle locating outside the wheel-mounting base. The fixing members are respectively mounted to the sidewalls of the wheel-mounting base. Each fixing member comprises an axle-receiving hole for securely engaging with an associated one of the ends of the axle. Each fixing member is movable between a first angular position in which the fixing member is disengagable from an associated one of the sidewalls of the wheel-mounting base and a second angular position in which the fixing member is securely engaged with the associated one of the sidewalls of the wheel-mounting base.

Each fixing member comprises a tube formed on an inner side thereof to thereby define the axle-receiving hole. The tube has an outer closed end for preventing entrance of alien objects and an inner open end for receiving an associated end of the axle.

Each sidewall of the wheel-mounting base comprises at least one engaging slot having an insertion section and a retaining section. Each fixing member comprises at least one hook that is received in the engaging slot. The hook is movable between the insertion section and the retaining section. Each fixing member is disengagable from the associated sidewall of the wheel-mounting base when the hook is in the insertion section, and disengagement of each fixing member from the associate sidewall of the wheel-mounting base is prevented when the hook is in the retaining section.

The engaging slot has a stop. The hook faces the stop when in the retaining section, thereby preventing disengagement of the fixing member by means of forcible outward pulling of the fixing member. The engaging slot has a stepped portion. The hook has a rib formed thereon. The stepped portion and the rib are so configured that the stepped portion stops the rib and thus prevents movement of the hook from the retaining section to the insertion section of the engaging slot.

Each fixing member may comprise plural holes for engaging with a tool for turning the fixing member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
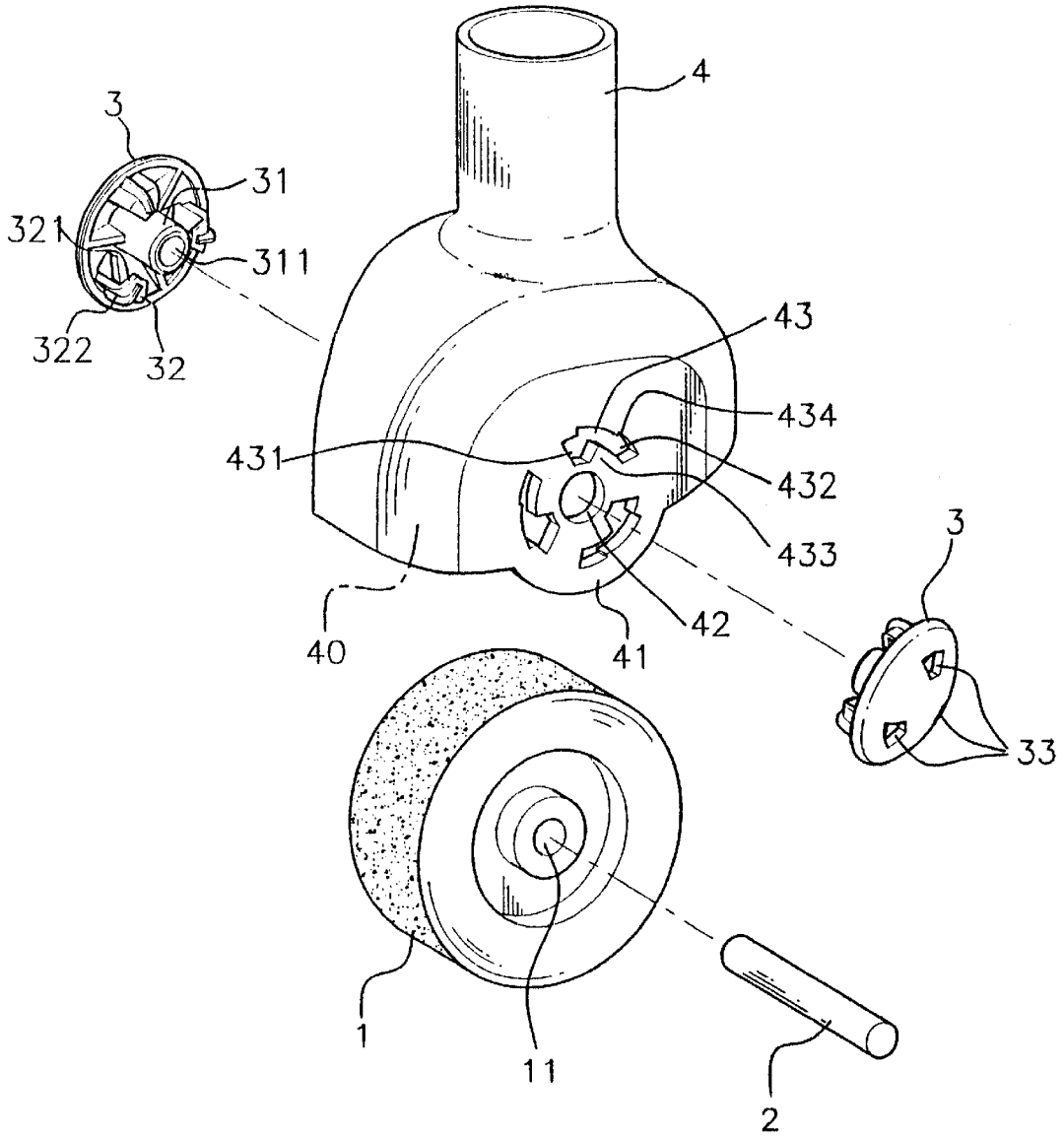
FIG. 1 is an exploded perspective view of a wheel assembly in accordance with the present invention.
Figure 2:
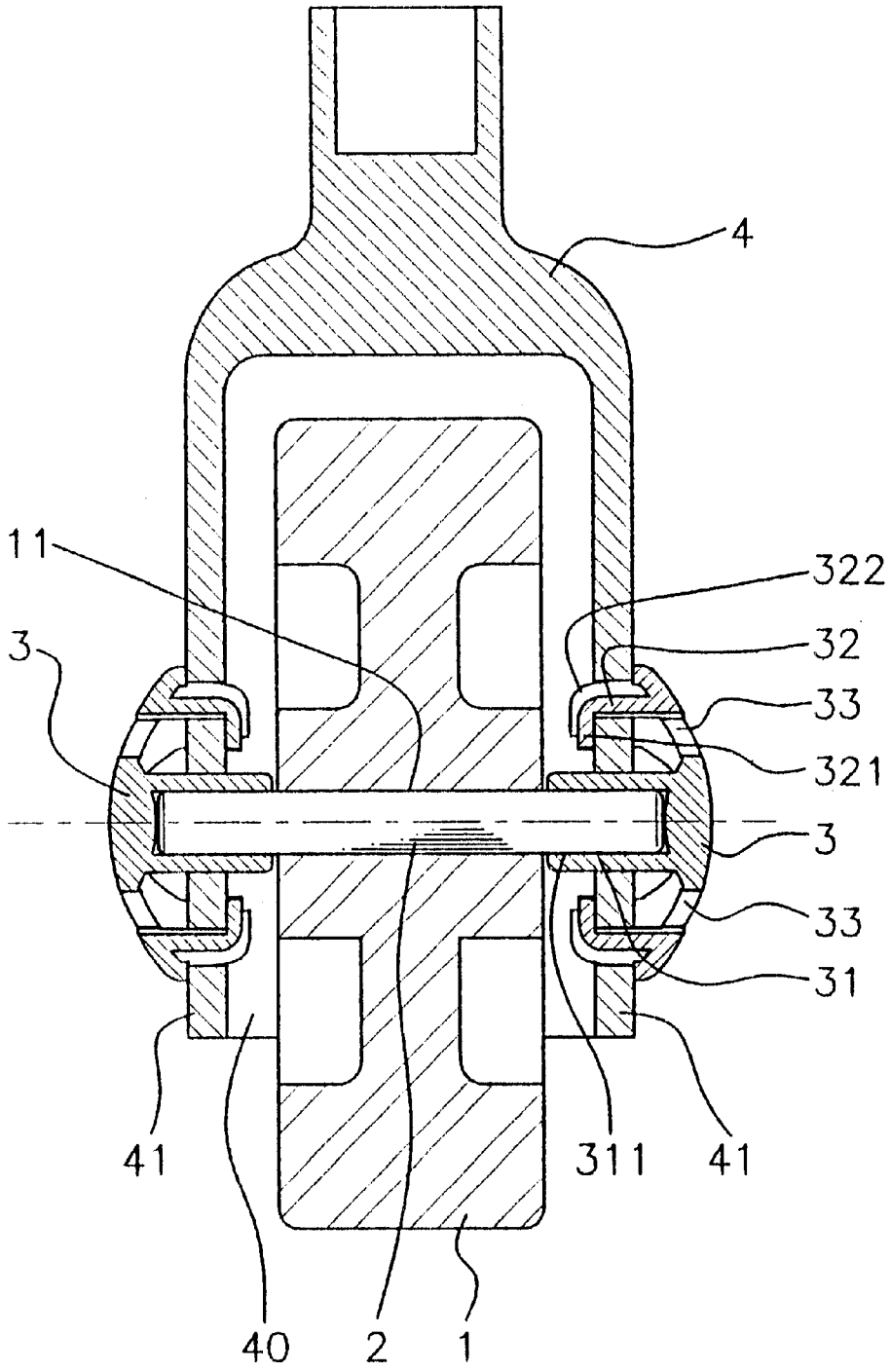
FIG. 2 is a sectional view of the wheel assembly in accordance with the present invention.

Referring to FIGS. 1 and 2, a wheel assembly in accordance with the present invention generally comprises a wheel 1, an axle 2, two fixing members 3, and a wheel-mounting base 4 that is a portion of an object such as a toy, baby utensil, or sport equipment.

The wheel-mounting base 4 comprises a compartment 40 that is delimited by two sidewalls 41 having aligned axle holes 42. At least one engaging slot 43 is defined in each sidewall 41. In this embodiment, three engaging slots 43 are defined in each sidewall 41 and located around the respective axle hole 42 at regular angular interval. Each engaging slot 43 includes an insertion section 431 and a retaining section 432. In addition, each engaging slot 43 may include a stepped portion 434 in the retaining section 432. As illustrated in FIG. 1, each engaging slot 43 has a stop 433 formed therein.

Each fixing member 3 comprises an axle-receiving hole 311. In a preferred embodiment, the axle-receiving hole 311 is defined in a tube 31 located in a central portion of the fixing member 3. The tube 31 has an outer closed end to prevent entrance of alien objects and an open inner end for receiving an associated end of the axle 2. At least one hook 32 is provided on a side of each fixing member 3 and includes a hooking portion 321. In this embodiment, there are three hooks 32 formed on the side of each fixing member 3 and located around the axle-receiving hole 311 at regular angular interval. In addition, a rib 322 is provided on each hook 32, which will be described later.

Figure 4:
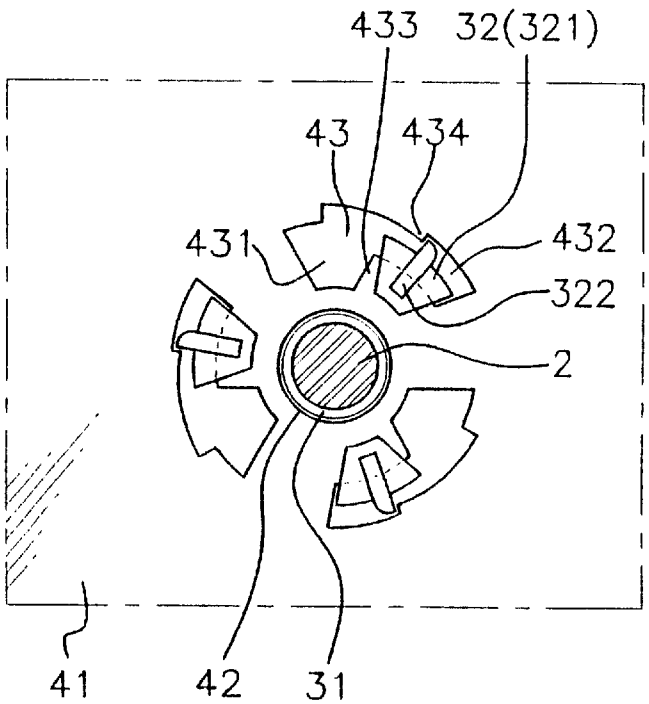
FIG. 4 is a view similar to FIG. 3, wherein the fixing member is in the engaged position.
Figure 3:
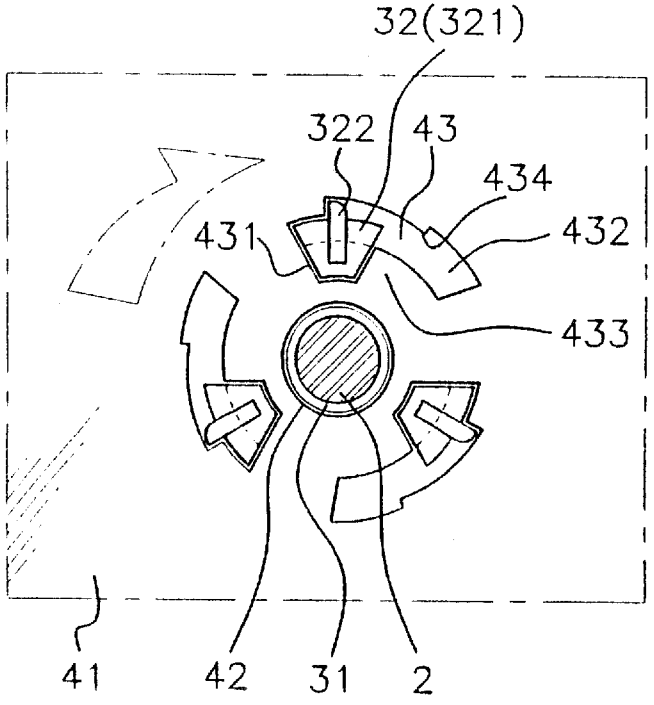
FIG. 3 is a side view, partly sectioned of a portion of the wheel assembly in accordance with the present invention, wherein a fixing member of the wheel assembly is in not in an engaged position.

In assembly, the wheel 1 is placed into the compartment 40 of the wheel-mounting base 4, and the axle 2 is extended through the aligned axle holes 42 of the wheel-mounting base 4 and an axle hole 11 of the wheel 1. The fixing members 3 are respectively engaged with two ends of the axle 2 outside the wheel-mounting base 4. Namely, each end of the axle 2 is securely engaged in the axle-receiving hole 311 of an associated one of the fixing members 3 via the inner open end of the axle-receiving hole 311. In addition, each hook 32 of each fixing member 3 is inserted into the insertion section 431 of an associated one of the engaging slots 43, as shown in FIG. 3. Next, each fixing member 3 is turned through a predetermined angle until each hook 32 of the fixing member 3 is moved into the retaining section 432 of the associated engaging slot 43. As illustrated in FIG. 4, the hooking section 321 of each hook 32 is in a position facing the stop 433 of the associated engaging slot 43, thereby preventing disengagement of the fixing member 3 by means of forcible outward pulling of the fixing member 3. In addition, each rib 322 is passed through the stepped portion 434 of the associated engaging slot 43 along a mounting direction, the stepped portion 434 and the rib 322 being so configured that the stepped portion 434 stops the rib 322 and thus prevents rotation of the fixing member 3 in a reverse direction opposite to the mounting direction unless a relatively large force is applied to turn the fixing member 3 in the reverse direction, best shown in FIG. 4.

Each fixing member 3 includes plural tool-engaging holes 33 surrounding the axle-receiving hole 311 and locating at regular angular interval for engaging with a specific tool (not shown) designed for driving the fixing member 3. This reduces the risk of damage to the wheel assembly.

According to the above description, it is appreciated that the present invention provides a wheel assembly that can be assembled easily, quickly, and reliably while providing an aesthetically pleasing appearance. In addition, the ends of the axle 2 are hidden in the fixing members 3 such that entrance of alien objects is prevented.

Although the invention has been explained in relation to its preferred embodiment, it is to be understood that many other possible modifications and variations can be made without departing from the scope of the invention as hereinafter claimed.

What is claimed is:

1. A wheel assembly for a toy, baby utensil, or sport equipment, comprising:

a wheel-mounting base that is a portion of one of a toy, baby utensil, and sport equipment, the wheel-mounting base comprising a compartment that is delimited by two sidewalls having aligned first axle holes;

a wheel received in the compartment of the wheel-mounting base and comprising a second axle hole;

an axle extending through the first axle holes of the wheel-mounting base and the second axle hole of the wheel with two ends of the axle locating outside the wheel-mounting base, and two fixing members respectively mounted to the sidewalls of the wheel-mounting base, each said fixing member comprising an axle-receiving hole for securely engaging with an associated one of the ends of the axle, each said fixing member being movable between a first angular position in which the fixing member is disengagable from an associated one of the sidewalls of the wheel-mounting base and a second angular position in which the fixing member is securely engaged with the associated one of the sidewalls of the wheel-mounting base.

2. The wheel assembly as claimed in claim 1, wherein each said fixing member comprises a tube formed on an inner side thereof to thereby define the axle-receiving hole, the tube having an outer closed end and an inner open end.

3. The wheel assembly as claimed in claim 1, wherein each said sidewall of the wheel-mounting base comprises at least one engaging slot having an insertion section and a retaining section, each said fixing member comprising at least one hook that is received in said at least one engaging slot, said at least one hook being movable between the insertion section and the retaining section, each said fixing member being disengagable from the associated sidewall of the wheel-mounting base when said at least one hook is in the insertion section, and disengagement of each said fixing member from the associate sidewall of the wheel-mounting base is prevented when said at least one hook is in the retaining section.

4. The wheel assembly as claimed in claim 3, wherein said at least one engaging slot has a stop, and wherein said at least one hook faces the stop when in the retaining section, thereby preventing disengagement of the fixing member by means of forcible outward pulling of the fixing member.

5. The wheel assembly as claimed in claim 4, wherein said at least one engaging slot has a stepped portion, said at least one hook having a rib formed thereon, said stepped portion and said rib being so configured that said stepped portion stops said rib and thus prevents movement of said at least one hook from the retaining section to the insertion section of said at least one engaging slot.

6. The wheel assembly as claimed in claim 3, wherein each said fixing member comprises plural holes for engaging with a tool for turning the fixing member.

7. The wheel assembly as claimed in claim 1, wherein each said sidewall of the wheel-mounting base comprises plural engaging slots that are located around an associated one of the first axle holes and spaced at regular angular interval, each of said plural engaging slots having an insertion section and a retaining section, each said fixing member comprising plural hooks that are located around the axle-receiving hole and spaced at regular angular interval, each of said plural hooks being received in an associated one of said plural engaging slots, each of said plural hooks being movable between the insertion section and the retaining section of the associated one of said plural engaging slots, each said fixing member being disengagable from the associated sidewall of the wheel-mounting base when each said hook is in the insertion section, and disengagement of each said fixing member from the associate sidewall of the wheel-mounting base is prevented when each said hook is in the retaining section.

8. The wheel assembly as claimed in claim 7, wherein each of said plural engaging slots has a stop, and wherein each of said plural hooks faces the stop of an associated one of said plural engaging slots when in the retaining section of the associated one of said plural engaging slots, thereby preventing disengagement of an associated one of the fixing members by means of forcible outward pulling of the associated one of the fixing members.

9. The wheel assembly as claimed in claim 8, wherein each of said plural engaging slots has a stepped portion, each of said plural of hooks having a rib formed thereon, said stepped portion and said rib being so configured that said stepped portion stops said rib and thus prevents movement of an associated one of said plural hooks from the retaining section to the insertion section of an associated one of said plural engaging slots.

10. The wheel assembly as claimed in claim 7, wherein each said fixing member comprises plural holes for engaging with a tool for turning the fixing member.

* * * * *